US007635008B2

(12) United States Patent
Follett et al.

(10) Patent No.: US 7,635,008 B2
(45) Date of Patent: Dec. 22, 2009

(54) FLOW RESTRICTING DEVICE HAVING SELF-FORMING CONDUITS

(75) Inventors: Dan B. Follett, Morgan, UT (US); David T. Cumming, Park City, UT (US); Emily B. Christopulos, Salk Lake City, UT (US)

(73) Assignee: Gaphog International, a Utah LLC, Salt Lake City, UT (US)

( * ) Notice: Subject to any disclaimer, the term of this patent is extended or adjusted under 35 U.S.C. 154(b) by 475 days.

(21) Appl. No.: 11/458,368

(22) Filed: Jul. 18, 2006

(65) Prior Publication Data

US 2008/0016906 A1 Jan. 24, 2008

(51) Int. Cl.
*F16L 55/00* (2006.01)

(52) U.S. Cl. ..... 138/108; 138/110; 138/113; 138/116

(58) Field of Classification Search ..... 138/110, 138/108, 106, 44, 113, 116
See application file for complete search history.

(56) References Cited

U.S. PATENT DOCUMENTS

| | | | | | |
|---|---|---|---|---|---|
| 1,856,109 | A | * | 5/1932 | Murray et al. | 174/146 |
| 2,153,787 | A | * | 4/1939 | Anderson | 166/241.4 |
| 2,531,658 | A | * | 11/1950 | Walsh | 138/101 |
| 3,642,308 | A | * | 2/1972 | Zeile et al. | 285/47 |
| 3,747,632 | A | | 7/1973 | Kok et al. | 137/375 |
| 4,093,818 | A | * | 6/1978 | Thwaites et al. | 174/505 |
| 4,754,590 | A | | 7/1988 | Gordon | 52/741 |
| 5,014,483 | A | | 5/1991 | Southern | 52/514 |
| 5,018,260 | A | * | 5/1991 | Ziu | 24/555 |
| 5,093,384 | A | | 3/1992 | Hayashi et al. | 521/159 |
| 5,497,809 | A | * | 3/1996 | Wolf | 138/113 |
| 5,687,771 | A | | 11/1997 | Clough | 138/89 |
| 5,692,545 | A | * | 12/1997 | Rodrigue | 138/115 |
| 5,878,784 | A | | 3/1999 | Sales et al. | 138/93 |
| 5,947,344 | A | | 9/1999 | Jangaard | 222/494 |
| 6,003,559 | A | * | 12/1999 | Baker | 138/108 |
| 6,062,267 | A | * | 5/2000 | Fleming | 138/114 |
| 6,080,461 | A | | 6/2000 | Wozniak et al. | 428/66.6 |
| 6,408,981 | B1 | | 6/2002 | Smith et al. | 181/315 |
| 6,428,017 | B1 | | 8/2002 | Galonska et al. | 277/616 |
| 2003/0074018 | A1 | | 4/2003 | Torstensen et al. | 606/197 |
| 2005/0067170 | A1 | | 3/2005 | Richard | 166/387 |

FOREIGN PATENT DOCUMENTS

| | | |
|---|---|---|
| DE | 003644414 | 4/1988 |
| EP | 000699862 | 3/1996 |
| WO | WO 9728540 | 8/1997 |

* cited by examiner

*Primary Examiner*—Patrick F Brinson
(74) *Attorney, Agent, or Firm*—Workman Nydegger

(57) ABSTRACT

A device comprising memory foam can be used for restricting fluid flow through a passageway. Such a device can include memory foam having a body defined by a first end and a second end and at least one external wall extending therebetween. The body of the expanded memory foam can have a cross-sectional profile with a shape and size to securely fit within the passageway so as to restrict fluid flow through the passageway. Additionally, the memory foam can have a receiving portion that extends from the first end to the second end that is configured for receiving an object that extends from the first end to the second end. The receiving portion can have various configurations and can include internal portions and external portions of the memory foam. The receiving portion can self-form a conduit around the object by expanding the memory foam around the object.

18 Claims, 2 Drawing Sheets

FLOW RESTRICTING DEVICE HAVING SELF-FORMING CONDUITS

BACKGROUND OF THE INVENTION

1. The Field of the Invention

The present invention is related to devices and systems that include memory foam for use in restricting the fluid flow (e.g. liquid or gas flow) in a passageway. More particularly, the present invention is related to flow restricting devices and systems having memory foam configured to expand and form conduits around objects disposed in a passageway so that the fluid flow in the passageway is restricted.

2. The Related Technology

Air conditioning systems have long been employed to regulate temperatures within buildings or rooms by generating and blowing heated or cooled air. Usually, the air conditioning system routes forced air through a series of ducts that open into the location needing to be cooled or heated. The air conditioning ducts can include vents and/or vent covers that regulate the amount of air being blown out of each duct. Often, the air conditioning system includes ducts that are pre-installed and are integrated fixtures of a building or room. Air conditioning systems that include ducts with vents and/or vent covers that regulate the air flow are well known in the art.

Recently, data storage facilities have been constructed to house computer equipment containing important data. The data storage facilities typically include at least one air conditioning system to regulate the temperature of the air within the room containing the computer equipment. Usually, the air conditioning system is configured to generate and force cool air into the data storage facility to regulate the temperature of the computer equipment. A data storage facility having a large number of computers may require multiple air conditioning systems in order to regulate the temperature because of the amount of heat produced by the large number of computers. Also, a single air conditioning system may have ducts and vents arranged so that cooled air is blown towards an air inlet of a computer (e.g. front of computer). Often the air conditioning system includes some ducts and vents that blow cool air towards the air outlet of a computer (e.g. back of computer), but the air outlet of the computer releases hot air due to the operation of the computer. The hot air produced by the computer can warm the cool air and render the air conditioning ineffective.

It has recently been found that selectively blowing cooled air toward a computer air inlet and maintaining cool air around the computer air inlet can be more beneficial than maintaining the data storage facility or data storage room housing the computers at a substantially homogenous temperature. Additionally, the cooled air can be prevented from being blown toward the computer air outlets and wasted. Accordingly, temperature gradients that are cooler around the computer air intakes compared to the computer air outlets can be easier and cheaper to maintain, as compared to regulating the temperature so that it is substantially homogenous throughout the data storage facility or data storage room. In part, this is because the computer air intake can receive cooled air and blow hot air out of the computer air outlet. As such, selectively cooling the air around the computer air intake without cooling the heated air around the computer air outlet can provide enhanced cooling without wasting cool air. Attempting to cool the heated air around the computer air outlet is a substantial waste of cooled air. Thus, selectively cooling the air around the computer air intake can be comparatively more cost-effective than standard cooling techniques that cool an entire room to a substantially homogenous temperature.

Additionally, data storage facilities or data storage rooms housing computers have been constructed to utilize air conditioning ducts for passing power cords and data cords between different computers. As such, a large number of cords can be disposed within an air conditioning duct and have one end extend out of a duct opening and connected to a computer and another end extending out of a different duct opening and connected to a different computer. The large number of cords passing through a single air conditioning duct can provide a complex problem when determining the proper endpoints of each cord, rearranging the cords, disconnecting the cords, and reconnecting the cords. Often, the cords emerge from a duct opening, and are plugged into the backs of computers close to the computer air outlet, which can position the computer air outlet in the back of the computer close to the duct opening.

While air conditioning ducts can include vents and vent covers to restrict the flow of cool air towards the computer air outlet, most vents and vent covers are not properly configured to allow cords to be passed therethrough and to restrict the flow of cool air. Additionally, some vents and vent covers may require the cords to be unplugged at one end and routed through the vent or vent cover; however, unplugging a cord or a plurality of cords in a data storage facility can be a daunting activity because of the complex problems associated with determining the proper endpoints of each cord, rearranging the cords, disconnecting the cords, and reconnecting the cords. Thus, the use of such vents and vent covers can have unfavorable consequences and the time required to route the cords through the vents or vent covers can be prohibitive.

Therefore, it would be advantageous to have a device that can be used to selectively restrict the flow of air through air conditioning ducts or from openings in air conditioning ducts. Additionally, it would be advantageous to have a device that can be used to selectively restrict the flow of air through air conditioning ducts containing power cords or data cords being passed therethrough. Further, it would be advantageous to have a device that can be retrofitted into air conditioning ducts to selectively restrict the flow of air without having to disconnect an end of a cord or plurality of cords that are disposed within the air conditioning duct.

SUMMARY OF THE INVENTION

Generally, the present invention relates to flow restricting devices and systems that can be used to overcome the foregoing problems in the art. Accordingly, the present invention can include flow restricting devices and systems that have memory foam for use in restricting the fluid flow in a passageway. As such, the memory foam can be configured to expand within a passageway in order to restrict fluid from flowing through the passageway past the flow restricting device. Also, the memory foam can be configured to self-form conduits around objects disposed in a passageway when the memory foam expands from a compressed state to an expanded state. Also, the memory foam can have portions with features adapted to receive various types of objects so that the memory foam can be compressed to receive the object and expand around the object to form a secure-contoured conduit around the object.

In one embodiment, the present invention can include a flow restricting device for restricting fluid flow through a passageway, such as an air conditioning vent or conduit. Such a flow restricting device can include a piece of memory foam having a body defined by a first end and a second end and at least one external wall extending therebetween. The body of the expanded memory foam can have a cross-sectional profile with a shape that ranges from circular to polygonal. Also, the expanded shape and size of the memory foam can securely fit within the passageway so as to restrict fluid flow through the passageway. Additionally, the memory foam can have a receiving portion that extends from the first end to the second end that is configured for receiving an object that extends from the first end to the second end. The receiving portion can have various configurations and can include internal portions and external portions of the memory foam. The receiving portion can self-form a conduit around the object by expanding the memory foam around the object.

In one embodiment, the flow restricting device for restricting fluid flow through a passageway can include a housing containing a piece of memory foam. The housing can include a body at least partially defining a chamber. As such, the chamber can have at least one wall that is open or the chamber can be defined by a combination of the housing body and another member. Also, the housing body can be configured to fit within the passageway. The memory foam can be disposed in the chamber of the housing so as to restrict fluid flow through the passageway. The memory foam can have a first end, a second end, and a receiving portion configured for receiving an object that extends from the first end to the second end. The receiving portion can self-form a conduit around the object by expanding the memory foam around the object.

In one embodiment, the present invention can include a flow restricting system for restricting fluid flow through a passageway. Such a system can include a housing and a piece of memory foam configured to be secured to or placed in the housing. The housing can include a body at least partially defining a chamber, and the body can be configured to fit within the passageway. The memory foam can have a first end, a second end, and an expanded shape and size that allow the memory foam to securely fit within the chamber so as to restrict fluid flow through the passageway. The memory foam can have a receiving portion configured for receiving an object that extends from the first end to the second end so that a conduit is formed around the object by expanding the memory foam around the object.

Additionally, the receiving portion that expands to self-form the conduit can be selected from the group consisting of a slit, hole, aperture, recess, cavity, collapsible hole, combinations thereof, and the like. Also, the receiving portion can be shaped and sized so as to receive a variety of objects that can be used within a passageway or extend through the passageway. For example, the object can be a flexible tubular member such as power cords, electronic communication cords, phone lines, fiber optic cords, and the like.

In one embodiment, the memory foam can be configured to be fire-retardant or fire-proof. That is, the memory foam can include compounds that retard or completely inhibit the ability of the memory foam to catch and sustain fire. This can be beneficial when the device is used in passageways that are exposed to heat, sparks, flames or other fire-starting conditions.

Additionally, the housing can have various configurations. As such, the housing can include a first end having an outwardly and/or inwardly projecting lip. Also, the housing can have a second end having an inwardly projecting shelf.

In one embodiment, the housing can be configured to open so as to open the chamber. A first wall of the housing can have a separable portion extending from a first end to a second end. The separable portion can divide a first portion of the first wall from a second portion of the first wall, and the first portion can be capable of separating from the second portion to open the housing. Further, the housing can include a second wall having a hinge so that actuation of the hinge separates the first portion of the first wall from the second portion of the first wall. Furthermore, the first portion can include a first fastener and the second portion can include a second fastener. The first fastener and second fastener can be configured to fasten together in order to couple the first portion of the first wall with the second portion of the first wall. For example, the first fastener can be a male fastener and the second fastener can be a female fastener so that the male fastener is received into the female fastener in order to couple the first portion with the second portion to form a continuous first wall. Furthermore, the housing can be made of a flexible material with an opening, so that the housing can flex to open the chamber and be relaxed to close the chamber. Optionally, the closed housing can be secured in the closed position.

These and other advantages and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings, in which.

DETAILED DESCRIPTION OF THE PREFERRED EMBODIMENTS

Figure 1:
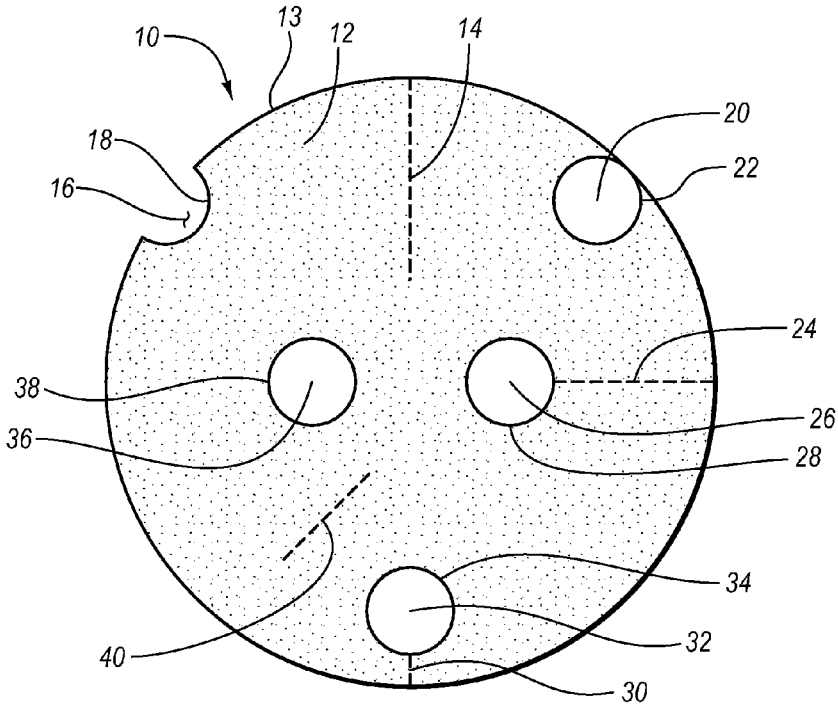
FIG. 1 is a cross-sectional profile illustrating an embodiment of a device having memory foam configured to self-form conduits around objects extending therethrough.

Generally, the present includes fluid flow restricting devices and systems that have memory foam for use in restricting the fluid flow in a passageway. The fluid flow restricting devices and systems can be configured for restricting or stopping the flow of a fluid or a gas through the passageway. The passageway can be exemplified by a duct, plenum, or the like, all of which can be used interchangeably in describing the flow restricting device. As such, the memory foam can be configured to expand within a passageway in order to restrict fluid from flowing through the passageway past the flow restricting device. Also, the memory foam can be configured to self-form conduits around objects disposed in a passageway when the memory foam expands from a compressed state to an expanded state. Also, the memory foam can have portions comprised of features adapted to receive various types of objects so that the memory foam can be compressed to receive the object and expand around the object to form a secure-contoured conduit around the object.

I. Introduction

Accordingly, an embodiment of the invention can include a flow restricting device having memory foam configured for removable placement as a barrier within a fluid passageway to restrict fluid flow. While the present flow restricting device can be configured to restrict the flow of liquids and gasses, a preferred embodiment is configured for restricting airflow. Accordingly, any reference herein to an airflow restricting device should be construed to cover a liquid flow restricting device.

The memory foam of a flow restricting device can be any foam that can return to its original shape after being compressed. The memory foam can be configured so that objects, such as cords, tubes, wires, fibers, and the like, can extend through the passageway before placement of the memory foam. The expanding memory foam can then self-form conduits around the objects after the memory foam has been placed and expanded within the passageway. The memory foam can have an expanded cross-sectional profile that is larger than the cross-sectional profile of the passageway so that compression of the memory foam enables placement into the passageway and expansion of the memory foam causes a secure fit within the passageway. As the memory foam expands towards the fully expanded state, the memory foam can form a barrier having a shape that corresponds with the cross-sectional profile of the passageway. During the expansion, any objects that extend through the passageway can cause conduits to be formed therearound by the memory foam. This can include conduits at the edge of the memory foam adjacent to the internal surface of the passageway, and conduits that extend through the body of the memory foam.

For example, one embodiment of the flow restricting device can include memory foam having a shape and size that can be compressed so as to fit within a passageway and is capable of expanding so as to form a barrier that restricts or inhibits the flow of fluid through the passageway. Additionally, the memory foam can expand to conform around any irregularities existing within the passageway. In the instance objects, such as cords, tubes, wires, fibers, and the like, extend through, or are disposed in, the passageway, the expanding foam can press up against such objects so as to self-form conduits around the objects. The self-formed conduit can significantly inhibitor stop fluid flow. In some instances, the memory foam can form a barrier that substantially seals the passageway with the self-forming conduits sealed around the objects extending therethrough.

In another example, the memory foam can have slits, recesses, cavities, apertures, or other like features that can be used for receiving the objects or passing the foregoing objects therethrough before allowing the foam to expand. Additionally, such features can be formed into the memory foam by compressing or otherwise deforming the foam. In the instance of slits along the length of the foam, which generally extend from the surface of the foam to an interior position, the walls that define the slit can be separated and placed around the objects. When the foam expands, the walls can seal the slits to the objects so as to form conduits around the objects. In the instance of recesses, which generally have cross-sectional profiles that are smaller than the objects, the walls that define the recess can compress against the objects along the length thereof to form the conduit as the memory foam expands. In the instance of cavities, bulky objects can be placed therein so that expansion of the memory foam conforms the cavity to the object. In the instance of apertures, which generally extend across the longitudinal length of the airflow restricting device, objects can be passed therethrough before compression and/or expansion of the foam so that expansion of the memory foam presses the walls of the aperture against the object in order to form the conduit.

In another example, the flow restricting device can have a housing with a lumen and/or chamber adapted for receiving the memory foam. The housing can have a shape and size that is configured to correspond with the cross-sectional profile of the passageway so as to securely fit therein. Accordingly, the memory foam can be received into the lumen and/or chamber and compressed such that an object can be passed through the lumen and/or chamber in order for the expanding memory foam to self-form a conduit around the object as the foam expands. In some instances, the memory foam is selectively coupled with the housing (e.g., at the luminal wall of the housing) or otherwise held by the housing.

II. Memory Foam

In accordance with the present invention, memory foam can be utilized to restrict fluid flow in a passageway, and to allow objects disposed in the passageway to extend past the memory foam. As used herein, the term "memory foam" is meant to refer to any open cell and/or closed cell foam having a relaxed, expanded state to which the foam returns after being compressed and released from compression. That is, the memory foam automatically attempts to return to the expanded state after being compressed. During the attempt to return to the expanded state, the memory foam can interact with objects that provide resistance against the expanding foam, thereby preventing the foam from expanding past the object. In the instance the memory foam expands against an object, the object can cause the memory foam to expand so as to conform to the shape of the object. Thus, the ability of memory foam to expand and conform in shape and size to objects has now been found to be useful for restricting fluid flow in passageways where objects are disposed by allowing compressed memory foam to expand to conform to the shape of the passageway to conform to the shape of and any objects located within the passageway.

Briefly, memory foam can be made from polymers, such as polyurethane, and additional chemicals that crosslink the polymers and/or add to the viscosity level of the foam, thereby increasing the density of the foam. Also, memory foam can be referred to as visco-elastic foam. The properties of memory foam, such as compressibility and/or expandability, can be altered by the additional chemicals used to process the memory foam and/or the overall density of the memory foam. For example, memory foam can be configured to become firmer when exposed to cooler temperatures and can become softer when exposed to warmer temperatures. Usually, the temperature sensitivity of the memory foam is conditioned for use in room temperature and to respond to heat provided by contact with skin, such as human skin. Higher density memory foam can be configured to respond to body heat and allow the memory foam to mold itself to the shape of a warm body, such as a hand, within a few minutes. Additionally, lower density memory foam can be configured to be pressure-sensitive and can mold more quickly to the shape of the body, such as by a hand compressing the memory foam.

In one embodiment, the memory foam can be temperature sensitive. That is, the memory foam can have a change in chemical and/or physical properties when heated or cooled from a base temperature. Usually, the base temperature is room temperature, which is standard to be about 25° C. As such, the memory foam can soften when heated to a temperature range within about 25° C. of the base temperature, such as when in contact with human skin. Also, the memory foam can harden when cooled to a temperature range within about 25° C. of the base temperature, such as when cooling air is blown against the foam when in an air conditioning duct.

The memory foam can be comprised of various types of thermoplastic materials. Some examples of suitable thermoplastic materials can include polyvinylchlorides ("PVC"), polyolefins, polyethylenes, polypropylenes, styrene-butadienes, styrene-isoprenes, polyesters, polyurethanes, polyamides, combinations thereof, and the like. In any event, any type of material that can be fashioned into memory foam that can function as described herein can be used in the present invention.

In one embodiment, the memory foam can be configured to conform to standards or regulations for a particular use. From time-to-time various regulatory entities (e.g., government) or consumer-safety entities (e.g., Underwriters Laboratories ("UL") implement standards or regulations with which a product needs to comply in order to be used for a particular purpose. As such, the memory foam can be configured to comply with such standards. In some instances the memory foam can be used in heating or cooling ducts in various types of buildings or with respect to various environments. As such, a specific use of the memory foam may have rules or regulations governing certain standards that materials need to comply with in order to be used therein. For example, air conditioning systems may require memory foam to have certain safety-related properties in order to be used as a barrier within an air conditioning duct, where the memory foam may need to have a certain level of fire-resistance to be used therein.

In one embodiment, the memory foam can be fire-resistant or fire-retardant. As such, the memory foam can be prepared and/or processed in a manner so that the memory foam resists and/or prevents catching fire. This can be accomplished by selection of the types of materials used in preparing the memory foam and/or the conditions under which the memory foam is prepared. For example, the memory foam can be prepared from a polymer that is fire-resistant.

In one embodiment, the memory foam can be impregnated with a chemical that is fire-resistant or fire-retardant in order to provide such a property to the memory foam. For example, such chemicals can include polybrominated diphenyl ethers, melamine, Tris(1,3-dichloro-2-propyl) phosphate ("TDCPP"), ammonium polyphosphate, and the like. In any event, any type of fire-resistant or fire-retardant chemicals that can be incorporated into memory foam to function as described herein can be used in the present invention.

In one embodiment, the memory foam can be an open cell foam. An open cell foam can be advantageously used when the environment in which the barrier is formed can permit at least some amount of fluid to flow past the memory foam. For example, an open cell memory foam can be used in an air conditioning duct when the flow merely needs to be partially restricted. In another example, an open cell memory foam can be used in an opening of an air conditioning duct in order to occlude the opening and to allow at least some air to pass through the memory foam.

In one embodiment, the memory foam can be a closed cell foam. A closed cell foam can be advantageously used when the environment in which the barrier is formed would preferably inhibit at least some amount of fluid from flowing past the memory foam. For example, a closed cell memory foam can be used in an air conditioning duct when the flow merely needs to be substantially restricted. In another example, a closed cell memory foam can be used in an opening of an air conditioning duct in order to occlude the opening and inhibit at least some air from passing through the memory foam.

A. Memory Foam Configurations

The present invention can use memory foam of various shapes, sizes, densities and/or other properties. While selected shapes and configurations of memory foam in accordance with the present invention are depicted and described in connection with the figures, it should be recognized that these are merely illustrations of some examples of the present invention. As such, the present invention can extend to other shapes and configurations consistent with the teachings provided herein.

FIG. 1 is a cross-sectional view of a piece of memory foam 10. The memory foam 10 has a shape and size defined by a body 12, which has a substantially circular cross-sectional profile. The body 12 of the memory foam 10 can include an external surface 13 that is designed to contact a circular inner surface of a passageway after expansion of the memory foam 10. However, other shapes can be used that correspond with the shape of a passageway.

In one embodiment, the memory foam 10 can include a slit 14 extending from the external surface 13 into the body 12 of the memory foam 10. The slit 14 can be separated at the external surface 13 and opened so as to form a receiving portion of the memory foam 10. As such, the slit 14 can be opened so that each side of the body 12 around the slit 14 is compressed and an object can be placed within the opened slit 14. After the object is placed in the slit 14, the memory foam 10 can be expanded so as to self-form a conduit around the object disposed in the slit 14. As such, a slit 14 can be used as a self-forming conduit.

In one embodiment, the memory foam 10 can include a recess 16 defined by a recess wall 18 at the external surface 13. The recess 16 can be formed and/or enlarged by compressing the body 12 of the memory foam 10 at the recess wall 18. As such, the recess wall 18 can be manipulated so that the recess 16 is opened so as to form a receiving portion of the memory foam 10. As such, the recess 16 can be opened so that the body 12 adjacent to the recess wall 18 is compressed and an object can be placed within the recess 16. After the object is placed in the recess 16, the memory foam 10 can be expanded so as to self-form a conduit around the object that is disposed in the recess 16. As such, a recess 14 at the external surface 13 can be used as a self-forming conduit. While the recess 14 can be cut or otherwise shaped into the external surface 13 of the memory foam 10, the recess 14 can be formed by merely compressing the memory foam 10 so that full expansion results in the recess 14 being filled with expanding foam.

In one embodiment, the memory foam 10 can include a cavity 20 defined by a cavity wall 22. The cavity 20 can be disposed within the body 12 of the memory foam 10 and/or adjacent to the external surface 13. The cavity 20 can be enlarged by compressing the body 12 of the memory foam 10 at the cavity wall 22. Also, the cavity 20 can be opened by tearing the cavity wall 22 at the external surface 13 of the memory foam. In any event, the cavity wall 22 can be manipulated so that the cavity 20 is enlarged and/or opened so as to form a receiving portion of the memory foam 10. As such, the cavity 20 can be enlarged and/or opened so that the body 12 adjacent to the cavity wall 22 is compressed and an object can be placed within the cavity. After the object is placed in the cavity 20, the memory foam 10 can be expanded so as to self-form a conduit around the object that is disposed in the cavity 20. As such, a cavity 20 adjacent to the external surface 13 can be used as a self-forming conduit.

In one embodiment, the memory foam 10 can include an internal cavity 26 defined by an internal cavity wall 28. The internal cavity 26 can be disposed within the interior of the body 12 of the memory foam 10. The internal cavity 26 can be accessed from the external surface 13 by including a cavity slit 24 that extends from the external surface 13 to the internal cavity 26. As such, the internal cavity 26 can be opened by separating the cavity slit 24 at the external surface 13 and opening the cavity slit 24 to access the internal cavity 26 so as to form a receiving portion of the memory foam 10. As such, the cavity slit 24 can be opened so that each side of the body 12 around the cavity slit 24 is compressed and an object can be passed therethrough and into the internal cavity 26. The internal cavity 26 can be enlarged by compressing the body 12 of the memory foam 10 at the internal cavity wall 28. In any event, the cavity slit 24 and internal cavity wall 22 can be manipulated so that the internal cavity 26 is enlarged and/or opened so as to form a receiving portion of the memory foam 10. As such, the internal cavity 26 can be enlarged and the cavity slit 24 can be opened so that the body 12 adjacent to the internal cavity wall 28 and cavity slit 24 is compressed and an object can be placed within the internal cavity 26. After the object is placed in the internal cavity 26, the memory foam 10 can be expanded so as to self-form a conduit around the object that is disposed in the internal cavity 26. As such, an internal cavity 26 that can be opened to the external surface 13 can be used as a self-forming conduit.

In one embodiment, the memory foam 10 can include a hole 32 defined by hole wall 34. The hole 32 can be disposed within the body 12 of the memory foam 10. The hole 32 can be accessed from the external surface 13 by including a hole slit 30 that extends from the external surface 13 to the hole 32. As such, the hole 32 can be opened by separating the hole slit 30 at the external surface 13 and opening the hole slit 30 to access the hole 32 so as to form a receiving portion of the memory foam 10. As such, the hole 32 can be opened so that each side of the body 12 around the hole slit 30 is compressed and an object can be passed therethrough and into the hole 32. The hole 32 can be enlarged by compressing the body 12 of the memory foam 10 at the hole wall 34. In any event, the hole 32 and hole wall 34 can be manipulated so that the hole 32 is enlarged and/or opened so as to form a receiving portion of the memory foam 10. As such, the hole 34 can be enlarged and the hole slit 30 can be opened so that the body 12 adjacent to the hole wall 34 and hole slit 30 are compressed and an object can be placed within the internal cavity 26. After the object is placed in the hole 32, the memory foam 10 can be expanded so as to self-form a conduit around the object that is disposed in the hole 32. As such, a hole 32 that can be opened to the external surface 13 can be used as a self-forming conduit.

In one embodiment, the memory foam 10 can include an aperture 36 defined by an aperture wall 38. The aperture 36 can be disposed within the body 12 of the memory foam 10. The aperture 36 can be enlarged by compressing the body 12 of the memory foam 10 around the aperture wall 38. In any event, the aperture 36 and aperture wall 38 can be manipulated so that the aperture 36 is enlarged so as to form a receiving portion of the memory foam 10. As such, the aperture 36 can be enlarged so that the body 12 adjacent to the aperture wall 38 is compressed and an object can be placed within the aperture 36. After the object is placed in the aperture 36, the memory foam 10 can be expanded so as to self-form a conduit around the object that is disposed in the aperture 36. As such, an aperture 36 can be used as a self-forming conduit.

In one embodiment, the memory foam 10 can include a collapsible hole 34 disposed within the body 12 of the memory foam 10. The collapsible hole 34 can be substantially similar to the foregoing slit 14; however, the collapsible hole 34 is disposed internally within the body 12 of the memory foam 10 and does not extend to the external surface 13. The collapsible hole 34 can be separated and opened so as to form a receiving portion of the memory foam 10. As such, the collapsible hole 34 can be opened so that each side of the body 12 around the collapsible hole 34 is compressed and an object can be placed within the collapsible hole 34. For example, the collapsible hole 34 in the opened orientation can be substantially as the aperture 36 described above. After the object is placed in the collapsible hole 34, the memory foam 10 can be expanded so as to self-form a conduit around the object disposed in the collapsible hole 34. As such, a collapsible hole 34 can be used as a self-forming conduit.

While the foregoing embodiments of memory foam in accordance with the present invention have been depicted and described in connection to a piece of memory foam having a circular cross-sectional profile, other shapes can be used depending on the shape of the passageway. Also, the foregoing embodiments depicted and described in connection with receiving portions of the memory foam being substantially circular so as to be capable of receiving objects that have similarly shaped and sized cross-sectional profile such as power cords, data cords, and the like. However, the receiving portions can have various other shapes to correspond with the cross-sectional profile of other types of objects such as those objects that have rectangular, square, or other polygonal shapes.

B. Use of Memory Foam in a Passageway

Generally, memory foam in accordance with the present invention can be used in a method which restricts fluid flow in a passageway. Such a method can include providing a passageway capable of passing fluid therethrough and having an object extending through the passageway. The memory foam can be compressed from an expanded cross-sectional profile that is the same or larger than the cross-sectional profile of the passageway to a size smaller than a cross-sectional profile of the passageway. The compressed memory foam can be inserted into the passageway and adjacent to the object so that a receiving portion of the memory foam receives the object. After receiving the object, the memory foam can be expanded so that the memory foam securely fits within the passageway and so that the receiving portion expands around the object thereby self-forming a conduit around the object.

In one embodiment, the receiving portion can be configured to include a slit, hole, aperture, recess, cavity, collapsible hole, or combination thereof. Also, the receiving portion of the memory foam can be configured to receive an object that is a substantially flexible tubular member.

Additionally, the memory foam can be warmed before and/or during the compression so as to be soft and compressible before inserting the memory foam into the passageway. Usually, the memory foam is heated up to about 25 degrees warmer than room temperature (e.g., 25° C.). For example, the warming can be achieved by holding and manipulating the memory foam with a hand of a person.

Also, the memory foam can be cooled after being inserted into the passageway. Usually, the memory foam is cooled up to about 25 degrees colder than room temperature. The cooling can be achieved with a cool fluid that is disposed or passing within the passageway. For example, the cooling can be achieved with cool air flowing through the passageway.

Figure 2:
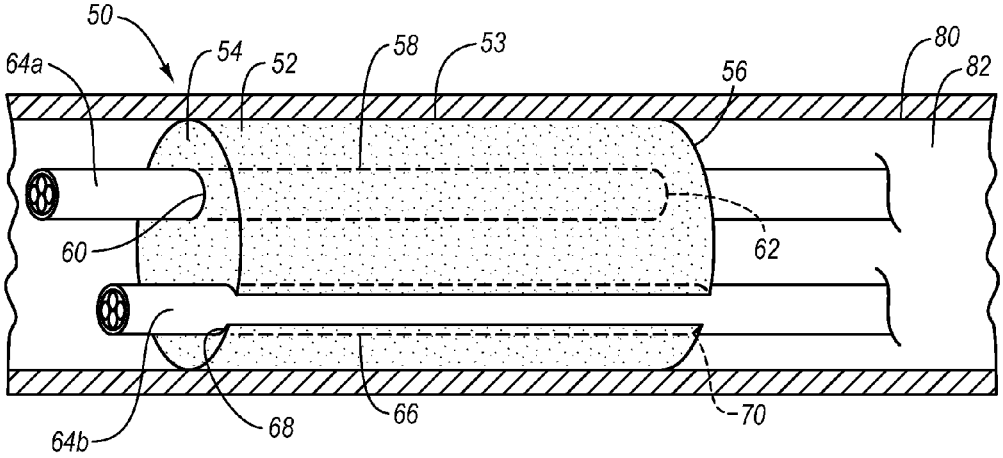
FIG. 2 is a perspective view of the device of FIG. 1 disposed within the lumen of a vent and having cords extending through self-forming conduits.

FIG. 2 is a perspective view of memory foam 50 having self-formed conduits 58, 66. As shown, the memory foam is disposed within the passageway 82 of an air conditioning duct 80. As such, the memory foam 50 has been previously compressed and had objects 64*a-b* received into the self-formed conduits 58, 66, and then expanded so as to form a barrier within the passageway 82 that can restrict fluid flow through the duct 80. The compressed memory foam 50 can be inserted into the passageway 82 before or after receiving the objects 64*a-b* into the self-formed conduits 58, 66.

The memory foam 50 is shown to have a first end 54 and a body 52 extending to an opposite second end 56. Accordingly, the memory foam 50 can include a self-formed internal conduit 58 that has a first opening 60 and a second opening 62. The first end 54 of the memory foam 50 can include the first opening 60 and the second end 56 can include the second opening 62. Additionally, an external surface 53 of the memory foam 50 is shown to have an external conduit 66. As such, the external conduit 66 can be disposed at the external surface 53 and has a first opening 68 in the first end 54 and a second opening 70 in the second end 56 of the memory foam 50.

As shown, the memory foam 50 has been compressed in a manner such that it can subsequently enlarge and/or open the internal conduit 58 and external conduit 66 so as to be capable of receiving the objects 46*a-b*. With respect to the internal conduit 58, the object 64*a* can be received into the internal conduit 58 by opening and/or enlarging the first opening 60 of the first end 54 and passing the object 64*a* therethrough. Additionally, the body 52 of the memory foam 50 can be compressed in a manner that creates, opens, and/or enlarges the conduit 58 so as to be capable of passing the object 64*a* therethrough. Also, the second opening 62 of the second end 56 can be opened and/or enlarged similarly to the first opening 60 of the first end 54 so that the object 64*a* can be passed therethrough. Internal conduits 58 can be useful for receiving objects 64*a* that include a free end (not shown) that can be threaded through the conduit 58.

After the object 64*a* is passed through the opened and/or enlarged conduit 58, the memory foam 50 can be relaxed so as to expand toward the fully expanded size. As the expansion occurs, the conduit 58 self-forms around the object 64*a* so as to fit securely therearound. The expansion of the memory foam 50 can occur all along the conduit 58 from the first end 54 to the second end 56 so that both the first end 60 and second end 62 close around the object 64*a*.

With respect to the external conduit 66, the entire external conduit 66 from the first opening 68 to the second opening 70 can be enlarged by compressing the body 52 of the memory foam 50 around the external conduit 66. The expanded external conduit 66 can then receive the object 64*b*. After the object 64*b* is received into the expanded external conduit 66, the memory foam 50 can be relaxed so as to expand into the fully-expanded size. As the expansion occurs, the external conduit 66 self-forms around the object 64*b* so as to fit securely therearound. The expansion of the memory foam 50 can occur all along the conduit 66 from the first end 68 to the second end 70.

External conduits 66, or those that can open to the external surface 53 (e.g. cavity 20, internal cavity 26, and hole 32 of FIG. 1), can be beneficial for receiving an object 64*b* that is already disposed within the passageway 82. The ability to self-form a conduit 66 with memory foam 50 around an object 64*b* that is already disposed within the passageway 82 can allow the object 64*b* to be received into the conduit 66 without disconnecting an end (not shown) of the object 64*b*. Thus, the external conduits 66 can be used to retrofit the memory foam 50 into the passageway 82 and around the existing object 64*b* without disconnecting an end of the object 64*b*.

III. Housing

The flow restricting device in accordance with the present invention can further include a housing configured to securely fit within a passageway and to securely contain memory foam within a chamber disposed within the housing. The housing can be configured for being disposed at an outlet of the passageway or at any position within the passageway. As such, the housing can have a shape and size that can be received into the passageway. Also, the chamber can be defined by the housing and can have a shape and size for receiving the memory foam.

A. Housing Configurations

Figure 3:
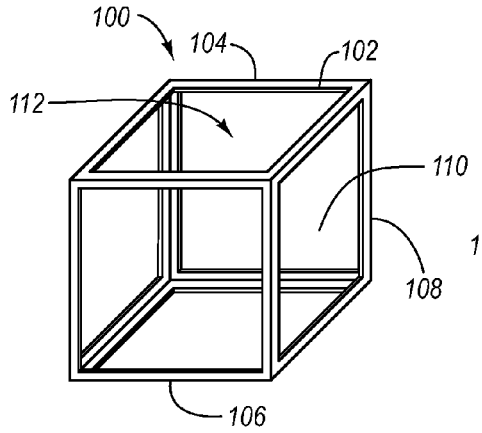
FIGS. 3-8 are perspective views of different embodiments of housings for memory foam configured to self-form conduits around objects extending therethrough

FIG. 3 is a perspective view of an embodiment of a housing 100 configured for being disposed within a passageway and for receiving memory foam in accordance with the present invention. As such, the housing 100 can be comprised of a body 102 that defines a chamber 110 disposed therein. The housing 100 can include at least one first end member 104 that is connected to at least one second end member 106 through at least one side member 108. The at least one first end member 104, at least one second end member 106, and at least one side member 108 can cooperate to define at least one wall 110. The at least one wall 110 can be a solid wall that at least partially encloses the chamber 112. Alternatively, the at least one wall 110 can be configured as an opening or an aperture that extends into the chamber 112. Additionally, the at least one first end member 104, at least one second end member 106, and at least one side member 108 can cooperate to define the chamber 112. The chamber 112 can be configured for receiving memory foam having self-forming conduits.

Figure 4:
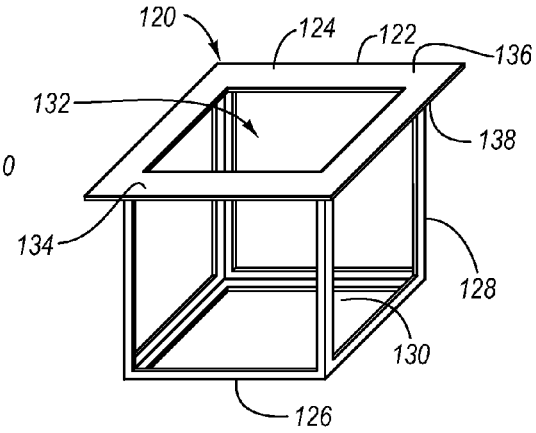

FIG. 4 is a perspective view of an embodiment of a housing 120 configured for being disposed at the opening of a passageway and for receiving memory foam in accordance with the present invention. As such, the housing 120 can be comprised of a body 122 that defines a chamber 132 disposed therein. The housing 120 can include at least one first end member 124 that is connected to at least one second end member 126 through at least one side member 128. The at least one first end member 124, at least one second end member 126, and at least one side member 128 can cooperate to define at least one wall 130. The at least one wall 130 can be a solid wall that at least partially encloses a chamber 132. Alternatively, the at least one wall 130 can be configured as an opening or an aperture that extends into the chamber 132. Additionally, the at least one first end member 124, at least one second end member 126, and at least one side member 128 can cooperate to define the chamber 132. The chamber 132 can be configured for receiving memory foam having self-forming conduits.

Additionally, the at least one first end member 124 can include a lip 134. The lip 134 can be defined by a first surface 136 and a second surface 138. The lip 134 can extend from the at least one first end member 124 outwardly away from the chamber 132. As such, the lip 134 can be disposed at the opening of a passageway so that the first surface 136 of the lip 134 is external to the passageway and so that the second surface 138 is disposed on the body defining the opening of the passageway. Thus, the second surface 138 of the lip 134 can be placed adjacent to the opening of the passageway.

Figure 5:
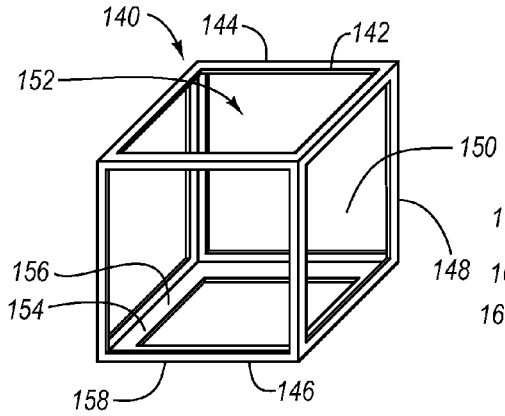

FIG. 5 is a perspective view of an embodiment of a housing 140 configured for being disposed within a passageway and for receiving memory foam in accordance with the present invention. As such, the housing 140 can be comprised of a body 142 that defines a chamber 152 disposed therein. The housing 140 can include at least one first end member 144 that is connected to at least one second end member 146 through at least one side member 148. The at least one first end member 144, at least one second end member 146, and at least one side member 148 can cooperate to define at least one wall 150. The at least one wall 150 can be a solid wall that at least partially encloses a chamber 152. Alternatively, the at least one wall 150 can be configured as an opening or an aperture that extends into the chamber 152. Additionally, the at least one first end member 144, at least one second end member 146, and at least one side member 148 can cooperate to define the chamber 152. The chamber 152 can be configured for receiving memory foam having self-forming conduits.

Additionally, the at least one second end member 146 can include a shelf 154. The shelf 154 can be defined by a first surface 156 and a second surface 158. The shelf 154 can extend from the at least one second end member 146 inwardly into the chamber 152. As such, the shelf 154 can be disposed within the chamber 152. The shelf 154 can be configured for holding the memory foam when disposed within the chamber 152 so that the memory foam is retained within the chamber. As such, the shelf 154 can hold the memory foam during or after expansion so that the memory foam is held in place and is prevented from slipping into the passageway.

Figure 6:
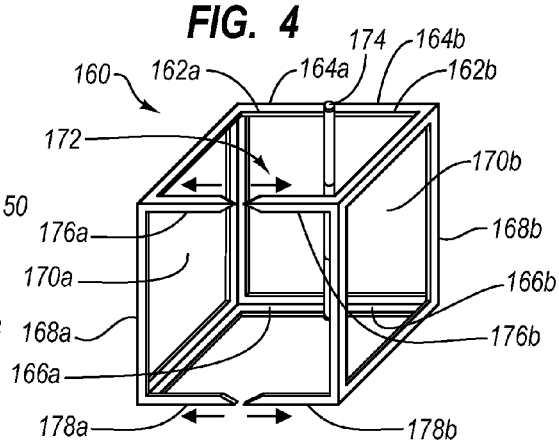

FIG. 6 is a perspective view of an embodiment of a two-piece housing 160 configured for being disposed within a passageway and for receiving memory foam in accordance with the present invention. As such, the two-piece housing 160 can be comprised of a first body 162*a* and a second body 162*b* that are combined to define a chamber 172 disposed therein. The first body 162*a* can include at least one first end member 164*a* that is connected to at least one second end member 166*a* through at least one side member 168*a*. The at least one first end member 164*a*, at least one second end member 166*a*, and at least one side member 168*a* can cooperate to define at least one first wall 170*a*. The at least one first wall 170*a* can be a solid wall that at least partially encloses the chamber 172. Alternatively, the at least one first wall 170*a* can be configured as an opening or an aperture that extends into the chamber 172.

The second body 162*b* can include at least one first end member 164*b* that is connected to at least one second end member 166*b* through at least one side member 168*b*. The at least one first end member 164*b*, at least one second end member 166*b*, and at least one side member 168*b* can cooperate to define at least one second wall 170*b*. The at least one second wall 170*b* can be a solid wall that at least partially encloses the chamber 172. Alternatively, the at least one second wall 170*b* can be configured as an opening or an aperture that extends into the chamber 172.

Additionally, the first body 162*a* and second body 162*b* can be coupled together through a hinge 174. Opposite of the hinge 174, the first body 162*a* can include a first top connecting member 176*a* and a first bottom connecting member 178*a*, and the second body 162*b* can include a second top connecting member 176*b* and a second bottom connecting member 178*b*. The hinge 174 can allow for the first body 162*a* to be opened so as to open the chamber 172. When the hinge 174 is actuated the first top connecting member 176*a* can be separated away from the second top connecting member 176*a* and the first bottom connecting member 178*a* can be correspondingly separated away from the second bottom connecting member 178*b*.

The chamber 172 can be opened by the first body 162*a* being opened away from the second body 162*b* through actuation of the hinge 174. This can allow for objects that are longer than the chamber 172 to be placed into the open chamber 172 and pass therethrough after the hinge 174 is actuated to close the chamber 172. For example, in the instance the object is a data cord the housing 160 can be opened by actuating the hinge 174 in order to open the chamber 172 so as to be capable of receiving the data cord into the chamber 172 without disconnecting the data cord. Also, this configuration can allow for the housing to be used to retrofit within a passageway already having objects, such as data cords, so that the objects do not have to be disconnected at one end and passed through the chamber 172.

In an alternative embodiment, the housing can be a single housing comprised of a flexible material that can be similarly opened. As such, the housing can be flexed or bent so as to open the chamber. Thus, a housing comprised of a flexible material can be used similarly as a housing with a hinge.

Figure 7:
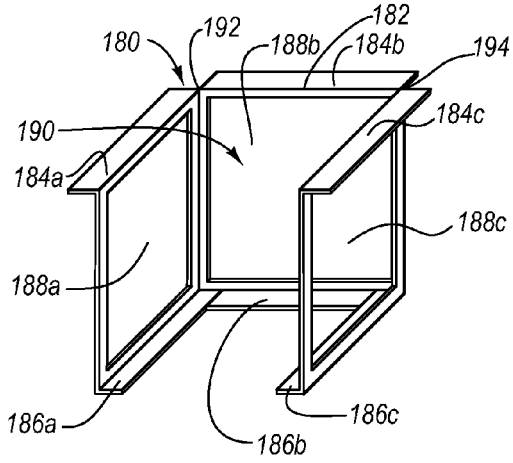

FIG. 7 is a perspective view of an embodiment of a three-sided housing 180 configured for being disposed within a passageway and for receiving memory foam in accordance with the present invention. As such, the three-sided housing 180 can be comprised of a body 182 that at least partially defines a chamber 182 disposed therein. The chamber 182 can be substantially open by being defined by three sides 186*a-c* and having an open side. The three-sided housing 180 can include the following: a first top member 184*a* that is connected to a first bottom member 186*a* through a first side member 188*a*; a second top member 184*b* that is connected to a second bottom member 186*b* through a second side member 188*b*; and a third top member 184*c* that is connected to a third bottom member 186*c* through a third side member 188*c*. The side members 188*a-b* can be solid walls, walls that define apertures, or the like.

Additionally, the three-sided housing 180 can be configured to include various other elements depicted and described in connection with FIGS. 3-6. For example, each of the top members 184*a-c* can be configured as a lip that projects outwardly from the chamber 190 similarly as depicted and described in connection with FIG. 4. Also, each of the bottom members 186*a-c* can be configured as a shelf that projects inwardly into the chamber 190 similarly as depicted and described in connection with FIG. 5. Further, the first members (184*a*, 186*a*, and/or 188*a*) can be coupled to the second members (184*b*, 186*b*, and/or 186*c*) via a flexible corner 192, which can allow the third members to bend or rotate with respect to the second members. Similarly, the third members (184*c*, 186*c*, and/or 188*c*) can be coupled to the second members (184*b*, 186*b*, and/or 186*c*) via a flexible corner 194, which can allow the third members to bend or rotate with respect to the second members. Accordingly, the flexible corners 192, 194 can allow the first members and third members to bend or rotate away from the second members in a manner similar to the function of the hinge 174 of FIG. 6.

Figure 8:
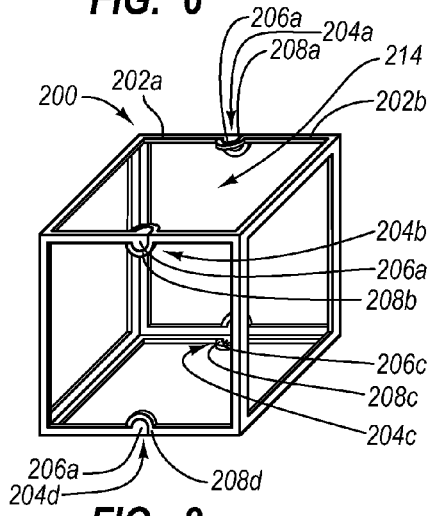

FIG. 8 is a perspective view of an embodiment of a couplable housing 200 configured for being disposed within a passageway and for receiving memory foam in accordance with the present invention. The couplable housing 200 can be comprised of a first body 202*a* and a second body 202*b* that defines a chamber 214 disposed therebetween. Both the first body 202*a* and second body 202*b* can be configured similarly as the three-sided housing 180 of FIG. 7. The first body 202*a* can be coupled to the second body 202*b* through at least one fastener 204*a-d*. A single fastener 204*a* can be comprised of a first fastener member 206*a* disposed on the first body 202*a* and a second fastener member 208*a* disposed on the second body 202*b*. As shown, the first fastener member 206*a* can be a male fastener that can be received into the second fastener member 208*a*, which is a female fastener. However, the first fastener member 206*a* and second fastener member 208*a* can be configured as other fasteners well known in the art.

The couplable housing 200 can be configured such that the first body 202*a* can be selectively coupled to the second body 202*b*. This can allow the chamber 214 within couplable housing 200 to be opened in the instance the first body 202*a* is not coupled to the second body 202*b*, or closed in the instance the first body 202*a* is coupled to the second body 202*b*. As such, the chamber 214 can be opened so that long objects, such as power or data cords, can be extended through the chamber 214 before the first body 202*a* is coupled to the second body 202*b* to form the couplable housing 200. As before, chambers 214 that can be opened are beneficial for retrofitting around existing power and data cords so that the cords do not have be disconnected and threaded through the chamber.

Additionally, the individual elements of the various housings depicted and/or described herein can be interchanged with respect to each other. This can allow features of one housing to be combined with features of another housing. For example, the lip 134 of FIG. 4 and the shelf 154 of FIG. 5 can be combined with the couplable housing 200 of FIG. 8. Moreover, the housings can be prepared from a variety of materials. Preferred materials include various plastics and metals.

B. Housing and Memory Foam System

The present invention can also include a flow restricting system comprised of a housing and memory foam having self-forming conduits. As such, the flow restricting system can include any of the memory foam configurations described herein. Additionally, the flow restricting system can include any of the housing configurations described herein. In one embodiment, the memory foam can be coupled to the housing. In another embodiment, the memory foam can be couplable with the housing and can be separated therefrom. In yet another embodiment, a housing having a shape and size corresponding to a passageway can be included in a system that has a plurality of memory foam pieces, wherein each memory foam piece can have a different configuration for different types of passageways and/or objects disposed in the passageways.

C. Use of Housing and Memory Foam System in a Passageway

Generally, a flow restricting system in accordance with the present invention can be used in a method of restricting fluid flow in a passageway. Such a method can include providing a passageway capable of passing fluid therethrough and having an object extending through the passageway with or without passing a free end of the object through a chamber in the housing. The housing can be inserted into the passageway with or without passing a free end of the object through a chamber in the housing. The housing can be configured to fit securely within the passageway, which fit can be produced by the use of friction or by being selectively coupled to the passageway. In one example, the housing can be bonded to the passageway through an adhesive. In another example, the housing can be bolted or otherwise fastened to the passageway. In any event, the housing can be disposed within the passageway such that the object extends through a chamber defined by a body of the housing.

The method can further include compressing a piece of memory foam to a size smaller than a cross-sectional profile of the chamber. Typically, the memory foam has an expanded cross-sectional profile that is the same or larger than the cross-sectional profile of the chamber. The memory foam can then be inserted into the chamber and disposed adjacent to the object so that a receiving portion of the memory foam receives the object. The memory foam can then be expanded so as to securely fit within the chamber and so that the receiving portion expands around the object. thereby self-forming a conduit around the object.

In one embodiment, the receiving portion can be configured to include a slit, hole, aperture, recess, cavity, collapsible hole, or combination thereof. Also the object can be a flexible tubular member, such as a power cord, data cord, or the like. In any event, the receiving portion can be configured for receiving any type of object.

In one embodiment, the memory foam can be warmed so as to be soft and compressible before inserting the memory foam into the chamber. The warming can be accomplished by a person holding the memory foam and applying pressure to the memory foam. Also, the memory foam can be cooled after being inserted into the chamber. The cooling can be accomplished by the memory foam coming into contact with a cool fluid within the passageway; for example, by passing cool air by the memory foam.

In one embodiment, the method can further include positioning the housing at an opening of the passageway so that a first end of the housing is disposed at the opening of the passageway, and so that an outwardly projecting lip of the first end of the housing outwardly projects from the opening. The projecting lip can prevent the first end of the housing from entering into the passageway.

In one embodiment, the housing can include a second end having an inwardly projecting shelf at least partially defining the chamber. As such, the memory foam can be positioned in the chamber on the shelf so that the expanded memory foam is disposed on the shelf.

In one embodiment, the housing can be configured to open so as to expose the chamber, which is illustrated by the housings of FIGS. 6 and 8. As such, the method can include the following: opening the housing so as to open the chamber; placing the housing around the object so that the object is disposed within the opened chamber; and closing the housing so that the chamber is closed around the object.

In one embodiment, the housing can include a first wall that has a separable portion extending from a first end of the wall to a second end of the wall. The separable portion can divide a first portion of the first wall from a second portion of the first wall and the first portion can be capable of separating from the second portion to open the housing and thereby open the chamber. As such, the method can include the following: opening the separable portion so as to separate the first portion of the first wall from the second portion of the first wall to open the chamber; inserting the object into the opened chamber; and closing the separable portion so as to adjoin the first portion of the first wall to the second portion of the first wall to close the chamber around the object.

In one embodiment, the housing can include a second wall having a hinge (FIG. 6) so that actuation of the hinge separates the first portion of the first wall from the second portion of the first wall. Also, the method can include actuating the hinge so as to open the chamber, and inserting the object into the chamber. This can be beneficial when the object is a cord that does not include a free end to pass through the chamber.

In another embodiment, the first portion can include a first fastener and the second portion can include a second fastener, wherein the first fastener and second fastener can fasten together to couple the first portion of the first wall with the second portion of the first wall. Optionally, the first fastener is a male fastener and the second fastener is a female fastener as shown in FIG. 8.

IV. Data Storage Facilities

In one embodiment of the invention, a data storage facility constructed to house computer equipment containing important data can include an air conditioning duct having an airflow restricting device for restricting air flow through the air conditioning ducts. As such, an airflow restricting device having memory foam in accordance with the present invention can be disposed within an air conditioning duct or at the opening of such a duct. Also, an air conditioning system can have a duct and vent arranged so that the cooled air is blown towards an air inlet of a computer (e.g. front of computer), where the duct is substantially devoid of an airflow restricting device. Additionally, the air conditioning system can include a duct with an opening that can blow cool air towards the air outlet of a computer (e.g., back of computer), and can include an airflow restricting device in such a duct. Thus, an airflow restricting device can inhibit cooled air from being blown on the computer air outlets and wasted.

Additionally, a data storage facility or data storage room housing computers can have power cords and data cords passing through an air conditioning duct having an airflow restricting device. As such, a large number of cords can be disposed within the air conditioning duct and passed through or around the airflow restricting device. having one end connected to a computer and another end connected to a different computer. Accordingly, the air conditioning duct can include the airflow restricting device to restrict the flow of cool air towards the computer air outlet, wherein the airflow restricting device can be configured to allow cords to be passed therethrough and to restrict the flow of cool air. Additionally, the airflow restricting device can be inserted into the air conditioning duct already having cords passing therethrough without requiring the cords to be unplugged at one end and routed through the airflow restricting device. Thus, the airflow restricting device can be used to restrict airflow in an air conditioning duct without unplugging a cord or a plurality of cords For example, the present invention can include an airflow restricting device that can be used to selectively restrict the flow of cool air through an air conditioning duct or from an opening in the air conditioning duct. Additionally, the airflow restricting device can be used to selectively restrict the flow of cool air through an air conditioning duct containing power cords or data cords being passed therethrough. Further, the airflow restricting device can be retrofitted into an air conditioning duct to selectively restrict the flow of cool air without having to disconnect an end of a cord or plurality of cords that are disposed within the air conditioning duct.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A system for restricting fluid flow through a passageway in an air conditioning system, the system comprising:

a housing with a body at least partially defining a chamber with an internal cross-sectional profile, the body having a external cross-sectional profile, the body having a first end with a first opening to the chamber opposite from a second end with a second opening to the chamber; and memory foam configured to be compressed and retained within the chamber of the housing so as to restrict fluid flow through the passageway of the air conditioning system, the memory foam having a first end, a second end, and a receiving portion configured for receiving an object that extends from the first end to the second end so that a conduit is self-formed around the object when the memory foam is expanded around the object.

2. A system as in claim 1, wherein the housing includes a first end having an outwardly projecting lip.

3. A system as in claim 1, wherein the housing includes a second end having an inwardly projecting shelf.

4. A system as in claim 1, wherein a first wall of the housing has a separable portion extending from the first end to a second end, wherein the separable portion divides a first portion of the first wall from a second portion of the first wall and the first portion is capable of separating from the second portion to open the housing from the first end to the second end.

5. A system as in claim 4, wherein the housing includes a second wall having a hinge so that actuation of the hinge separates the first portion of the first wall from the second portion of the first wall.

6. A system as in claim 4, wherein the first portion includes a first fastener and the second portion includes a second fastener, wherein the first fastener and second fastener fasten together to couple the first portion of the first wall with the second portion of the first wall.

7. A system for restricting air flow through an air conditioning passageway, the system comprising:

a housing with a body at least partially defining a chamber with an internal cross-sectional profile, the body having a first end with a first opening to the chamber opposite from a second end with a second opening to the chamber; and memory foam having a first end, a second end, and an expanded cross-sectional profile that is larger than the internal cross-sectional profile and a compressed cross-sectional profile that is smaller than the internal cross-sectional profile of the chamber such that the memory foam can be inserted into the chamber through one of the first opening or second opening while compressed and retained within the chamber while expanded and securely fits and is retained within the chamber so as to restrict fluid flow through the passageway, the memory foam having a receiving portion configured for receiving an object that extends from the first end to the second end so that a conduit is self-formed around the object when the memory foam member is expanded around the object.

8. A system as in claim 7, wherein the object is a flexible tubular member.

9. A system as in claim 7, wherein the housing includes a first end having an outwardly projecting lip.

10. A system as in claim 7, wherein the housing includes a second end having an inwardly projecting shelf at least partially defining the chamber.

11. A system as in claim 7, wherein a first wall of the housing has a separable portion extending from a first end of the first wall to a second end of the first wall, wherein the separable portion divides a first portion of the first wall from a second portion of the first wall and the first portion is capable of separating from the second portion to open the housing.

12. A system as in claim 11, wherein the housing includes a second wall having a hinge so that actuation of the hinge separates the first portion of the first wall from the second portion of the first wall.

13. A system as in claim 11, wherein the first portion includes a first fastener and the second portion includes a second fastener, wherein the first fastener and second fastener fasten together to couple the first portion of the first wall with the second portion of the first wall.

14. A system for restricting air flow through an air conditioning passageway, the device comprising:

a housing with a body at least partially defining a chamber with an internal cross-sectional profile, the body having a first end with a first opening to the chamber opposite from a second end with a second opening to the chamber, wherein the housing has a separable portion extending from the first end to the second end, wherein the separable portion divides a first portion of the body from a second portion of the body and the first portion is capable of separating from the second portion to open the housing; and memory foam having a first end, a second end, and an expanded cross-sectional profile that securely fits within the chamber so as to restrict fluid flow through the passageway, the memory foam having a receiving portion configured for receiving an object that extends from the first end to the second end so that a conduit is formed around the object when the memory foam member is expanded around the object wherein the first portion includes a first fastener and the second portion includes a second fastener, wherein the first fastener and the second fastener fasten together to couple the first portion of the body with the second portion of the body.

15. A system as in claim 14, wherein the conduit is self-formed by expansion of the memory foam.

16. A system as in claim 14, wherein the receiving portion is a slit.

17. A system as in claim 14, wherein the first end has an outwardly projecting lip.

18. A system as in claim 14, wherein the second end has an inwardly projecting shelf.

* * * * *

UNITED STATES PATENT AND TRADEMARK OFFICE

CERTIFICATE OF CORRECTION

PATENT NO. : 7,635,008 B2
APPLICATION NO. : 11/458368
DATED : December 22, 2009
INVENTOR(S) : Follet et al.

It is certified that error appears in the above-identified patent and that said Letters Patent is hereby corrected as shown below:

Title Page
Item 75, Inventor 3 (Christopulos), change "Salk" to --Salt--

Drawings
Sheet 2, replace FIG. 8 with the figure depicted herein below, wherein the first fastener member of fastener 204b has been labeled as --206b--, and the first fastener member of fastener 204d has been labeled as --206d--

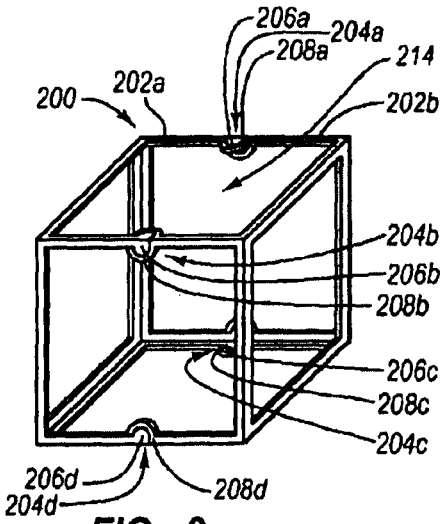

FIG. 8

Column 5
Line 6, change "gasses" to --gases--
Line 39, change "instance" to --instance of--
Line 44, change "inhibitor stop" to --inhibit--

Signed and Sealed this

Sixth Day of July, 2010

David J. Kappos

David J. Kappos
*Director of the United States Patent and Trademark Office*

Column 8
Line 41, change “14” to --16--
Line 43, change “14” to --16--
Line 44, change “14” to --16--
Line 46, change “14” to --16--

Column 9
Line 13, change “22” to --28--
Line 40, change “34” to --32--
Line 43, change “internal cavity 26” to --hole 32--
Line 64, change “34” to --40--
Line 65, change “34” to --40--
Line 67, change “34” to --40--

Column 10
Lines 1-11, change all 8 instances of “34” to --40--
Line 21, change “profile” to --profiles--

Column 11
Line 19, change “46a-b” to --64a-b--

Column 12
Line 13, change “110” to --112--

Column 13
Line 53, change “176a” to --176b--
Line 63, change “cord” to --cord,--

Column 14
Line 14, change both instances of “182” to --190--
Line 15, change “186a-c” to --188a-c--
Line 23, change “188a-b” to --188a-c--
Line 35, change “186c” to --188b--
Line 39, change “186c” to --188b--

Column 15
Line 4, change “chambers” to --chamber--
Line 6, change “have” to --have to--

Column 17
Line 26, change “cords” to --cords.--
Line 51, change “a external” to --an external--